US005361056A

United States Patent [19]

Wang

[11] Patent Number: 5,361,056

[45] Date of Patent: Nov. 1, 1994

[54] CORRECTION COIL CABLE

[75] Inventor: Sou-Tien Wang, Danville, Calif.

[73] Assignee: United States Department of Energy, Washington, D.C.

[21] Appl. No.: 682,833

[22] Filed: Apr. 9, 1991

[51] Int. Cl.[5] ..... H01F 5/00; H01B 12/00; H01B 7/00; H01B 5/02

[52] U.S. Cl. ..... 335/299; 174/125.1; 174/117 R; 174/133 R; 174/114 R; 335/213

[58] Field of Search ..... 335/299, 213; 174/117

[56] References Cited

U.S. PATENT DOCUMENTS

| | | | |
|---|---|---|---|
| H909 | 4/1991 | Danby | 328/233 |
| 1,972,319 | 9/1934 | Rypinski | 175/359 |
| 2,093,368 | 9/1937 | Rypinski | 175/336 |
| 2,120,973 | 6/1938 | Dietze et al. | 179/173 |
| 2,140,553 | 12/1938 | Rypinski | 175/372 |
| 3,393,268 | 7/1968 | Meyer | 174/117 R |
| 3,717,720 | 2/1973 | Snellman | 174/131 A |
| 4,319,072 | 3/1982 | Wilhelm | 174/34 |
| 4,574,261 | 3/1985 | Cochran | 335/299 |
| 4,611,390 | 9/1986 | Tanaka | 29/599 |
| 4,641,812 | 2/1986 | Vanderlaan et al. | 251/65 |

FOREIGN PATENT DOCUMENTS

| | | | |
|---|---|---|---|
| 118816 | 2/1927 | Switzerland | 174/114 |

*Primary Examiner*—Leo P. Picard
*Assistant Examiner*—Stephen T. Ryan
*Attorney, Agent, or Firm*—Miguel A. Valdes; Roger S. Gaither; William R. Moser

[57] ABSTRACT

A wire cable assembly (10, 310) adapted for the winding of electrical coils is taught. A primary intended use is for use in particle tube assemblies (532) for the superconducting super collider. The correction coil cables (10, 310) have wires (14, 314) collected in wire arrays (12, 312) with a center rib (16, 316) sandwiched therebetween to form a core assembly (18, 318). The core assembly (18, 318) is surrounded by an assembly housing (20, 320) having an inner spiral wrap (22, 322) and a counter wound outer spiral wrap (24, 324). An alternate embodiment (410) of the invention is rolled into a keystoned shape to improve radial alignment of the correction coil cable (410) on a particle tube (733) in a particle tube assembly (732).

3 Claims, 3 Drawing Sheets

CORRECTION COIL CABLE

The Government has rights in this invention pursuant to Contract No. DE-AC03-89SF18433 awarded by the U.S. Department of Energy.

BACKGROUND OF THE INVENTION

The present invention relates generally to the field of the manufacture of electrical coil windings, and more particularly to a unique cable assembly for use in winding coils having small wires and a large number of winding turns. The predominant current usage of the correction coil cable of the present invention is as the winding wire for correction coils in the superconducting super collider and in similar devices which might be developed in the future.

The varying needs of the electronics industry have produced a very great variety of different electrical coil configurations adapted to specialized purposes and a corresponding variety of methods for producing them. For example, U.S. Pat. No. 4,574,261, issued to Cochran, teaches an unusual coil having metal foil windings separated by an film insulation and further having a unique cooling means. However, the advances in technology which have allowed for development of a superconducting super collider (SSC) have posed a heretofore unknown set of requirements upon those persons engaged in the attempt to wind correction coils therefor.

The magnets in question must be extremely small size in relation to the great quantity of individual and separate windings required and in relation to the field which those windings are required to produce. Furthermore, since these magnets are field trimming coils, they may require individual leads from each winding set. Furthermore, in this application, current must be kept relatively low (in the range of approximately 100 A) in order to reduce helium boil off in the SSC. Additional requirements are that the coils must be stacked on top of each other coaxially so that the total coil length is maximized for the space available, and further so that operating field levels within the coil will be as low as possible to ensure that the correction coil will not quench (drop out of the superconducting condition and return to normal conduction properties). Furthermore, cost analysis has shown that a stacked coil configuration is most cost effective. This combination of requirements necessitates the use of very small wires, which makes the coil winding and coil assembly processes very difficult using known coil winding materials and methods.

Yet another factor which has come into consideration in the development of the present invention is that it has been the accepted wisdom in the field that the random aspect of wire placement which resulted from the best known prior art methods for producing these coils was not a serious problem. However, the inventor has demonstrated that a significant improvement can be had by reducing that randomness as much as possible.

Prior to the advent of the present invention, developmental correction coils for the SSC have been produced using individual wire strands wound using relatively conventional techniques. All of the prior art correction coil windings within the inventor's knowledge have been extremely expensive to produce, given the great care that must be exercised to carefully place the individual wire strands. Furthermore, even given the great effort and expense applied to the task, the resulting correction coils have been less than ideally uniform.

No prior art correction coil winding means, to the inventor's knowledge, has successfully provided a uniformly wrapped coil. Even the most successful correction coil winding materials and methods to date have produced coils having windings with at least some uneven spaces therebetween resulting in poor performance related to poor mechanical array within a winding cross section and, further, have resulted in coils which are very expensive to produce due to the care which must be taken in the production and also due to a high proportion of unacceptable end product.

SUMMARY OF THE INVENTION

Accordingly, it is an object of the present invention to provide a parallel wire cable assembly, having individually insulated wires, suitable for winding electrical coils.

It is another object of the present invention to provide a means for improving the quality of SSC correction coils.

It is still another object of the present invention to provide a means for insuring regular spacing of electrical coil wires.

It is yet another object of the present invention to provide an economical means for winding electrical coils having therein a great quantity of small wires.

It is still another object of the present invention to provide a means for improving the reliability of correction coils.

It is yet another object of the present invention to provide a means for improving the repeatability of correction coil manufacture, in the sense that each of a plurality of coils will more closely resemble the others.

It is still another object of the present invention to provide an improved SSC correction coil.

It is yet another object of the present invention to provide a coil wrapping assembly which is relatively economical to produce.

Briefly, the preferred embodiment of the present invention is a cable assembly having a ribbon like center rib sandwiched between two arrays of insulated parallel wires. The wires are held in place on the rib by a spiral wrapping of Kapton TM film, and a spiral wrapping of fiberglass ribbon forms an outer covering for the cable. The preferred embodiment of the present invention, adapted for use in SSC correction coils, has fourteen wires in each of the two arrays. A first equally preferred alternate embodiment has six wires in each of the two arrays. A second equally preferred alternate embodiment of the invention is like the first preferred embodiment of the invention except that the second equally preferred embodiment is rolled after assembly to keystone the cross sectional shape of the assembly to more readily conform to the shape of the beam tube on which the correction coil is to be wound. In each of the several examples of the invention, the parallel wires of the invention are connected so as to act like as serial coil windings after the cable assembly is wrapped around a winding land.

The wires used in the preferred embodiment, the first equally preferred alternate embodiment and the second equally preferred alternate embodiment of the invention are all a multifilamentary superconducting wire strand with a polyimide insulation coating.

An advantage of the present invention is that spacing and positioning of wires within an electrical coil is more regular.

A further advantage of the present invention is that coils produced using the inventive cable assembly produce more regular magnetic fields.

Still another advantage of the present invention is that complex coils can be produced more economically using the inventive cable assembly, as compared to prior art methods of coil production.

Yet another advantage of the present invention is that successive iterations of correction coils produced using the inventive cable assembly are more similar to each other than could be expected using prior art assembly methods.

Still another advantage of the present invention is that the likelihood of producing a correction coil having poor or unacceptable performance characteristics is reduced.

Yet another advantage of the present invention is that correction coils produced using the inventive cable assembly are more reliable in operation.

These and other objects and advantages of the present invention will become clear to those skilled in the art in view of the description of the best presently known modes of carrying out the invention and the industrial applicability of the preferred embodiments as described herein and as illustrated in the several figures of the drawing.

DETAILED DESCRIPTION OF THE INVENTION

The best presently known mode for carrying out the invention is a wire cable assembly for use in the winding of electrical coils. The predominant expected usage of the inventive coil winding cable is in the field of particle research and related industry, particularly in the superconducting super collider wherein the ability to economically produce a multitude of similar high quality coils is desirable.

Figure 1:
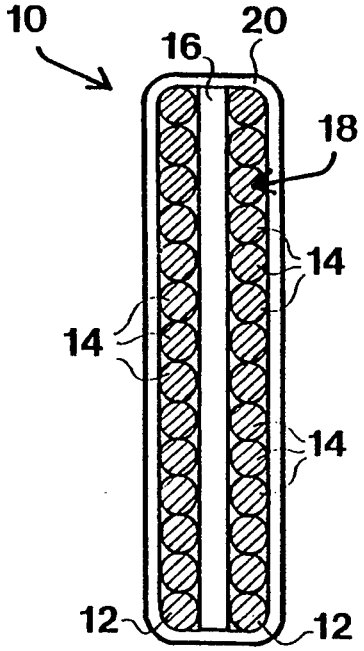
FIG. 1 is an elevational cross sectional view of a first presently preferred embodiment of a correction coil cable assembly, according to the present invention.

The correction coil cable of the presently preferred embodiment of the present invention is illustrated in a cross sectional elevational view in FIG. 1 and is designated therein by the general reference character 10. The presently preferred embodiment 10 of the present invention has two wire arrays 12 with fourteen wires 14 in each array 12. The wires 14 are multifilament niobium/-titanium (NbTi) superconducting wires (in a copper matrix) with a polyimide insulative coating, having an outside diameter of 0.416 mm, such as are customarily used in coil windings for the superconducting super collider. The wires 14 are not unique to the present invention.

A center rib 16 is sandwiched between the two wire arrays 12. In the presently preferred embodiment 10 of the invention, the center rib 16 is constructed of a thin ribbon of G-10 grade fiberglass material. Specifically, G-10 CR, which is the cryogenic grade of G-10 is used in this application. The center rib 16 is provided to help retain the shape of the correction coil cable 10 while maintaining sufficient flexibility to allow the correction coil cable 10 to be bent and wrapped as required. In accordance with this purpose, the center rib 16 of the presently preferred embodiment 10 of the invention is approximately 0.300 mm thick.

Figure 2:
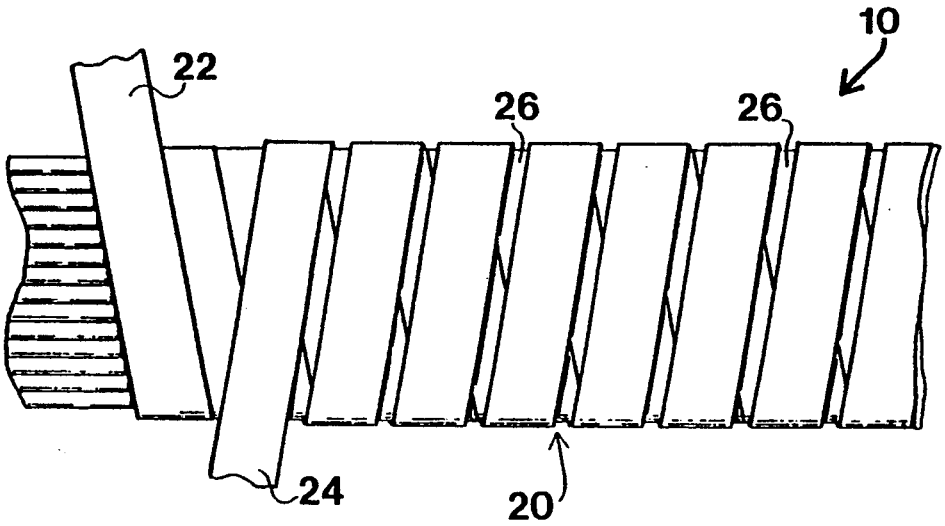
FIG. 2 is a side elevational view of the first presently preferred embodiment of a correction coil cable assembly, according to the present invention.

The two wire arrays 12 and the center rib 16 form a core assembly 18 around which an assembly housing 20 is constructed. FIG. 2 is a side elevational view of the presently preferred embodiment 10 of the correction coil cable of the present invention. As can be seen in the view of FIG. 2, the assembly housing 20 has an inner spiral wrap 22 and an outer spiral wrap 24. The inner spiral wrap 22 is made of Kapton insulation tape approximately 0.025 mm thick and approximately 6.4 mm wide. The inner spiral wrap 22 is wrapped around the core assembly 20 with a 50% overlap, such that each successive turn of the inner spiral wrap 22 around the core assembly 20 advances the inner spiral wrap 22 approximately 3.2 mm along the core assembly 20. In addition to its insulative properties, Kapton was chosen for use in this application because it does not tend to degrade in the presence of radioactive phenomena, as do other similar materials.

The outer spiral wrap 24 is made of B-stage fiberglass tape approximately 1.25 mm thick and approximately 6.4 mm wide. As illustrated in the drawing of FIG. 2, the outer spiral wrap 24 is wound counter to the inner spiral wrap 22, leaving a cooling channel 26 approximately 1.6 mm wide between each successive wrap. While the invention might readily be practiced using any of a great variety of materials, the inventor has found that the above described materials are well suited to the present SSC application. Furthermore, while the invention might readily be practiced using components having dimensions considerably different from those found in the presently preferred embodiment 10 of the invention, the inventor has found that the above described dimensions provide a workable compromise between flexibility and the ability of the correction coil cable 10 assembly to hold its shape and maintain consistency of relationship of the wires 14 during assembly and use.

Figure 3:
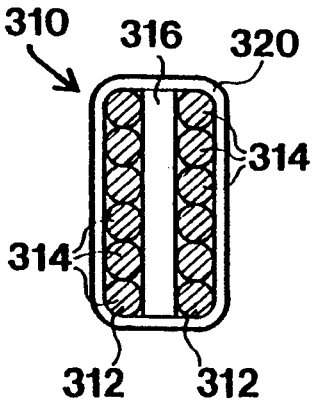
FIG. 3 is an elevational cross sectional view of a first equally preferred alternate embodiment of a correction coil cable assembly, according to the present invention.

An equally preferred alternate embodiment of the present invention is illustrated in FIG. 3 and is designated therein by the general reference character 310. The alternative embodiment 310 of the invention is very similar to the first preferred embodiment 10, differing essentially only in that the each of two wire arrays 312 has therein only six wires 314. A center rib 316 and an assembly housing 320 are constructed of like materials and in like fashion as are the center rib 16 and the assembly housing 20 of the first presently preferred embodiment 10 of the invention, with dimensions adjusted as required to accommodate the smaller number of wires 314 in the first equally preferred alternate embodiment 310 of the invention.

Figure 4:
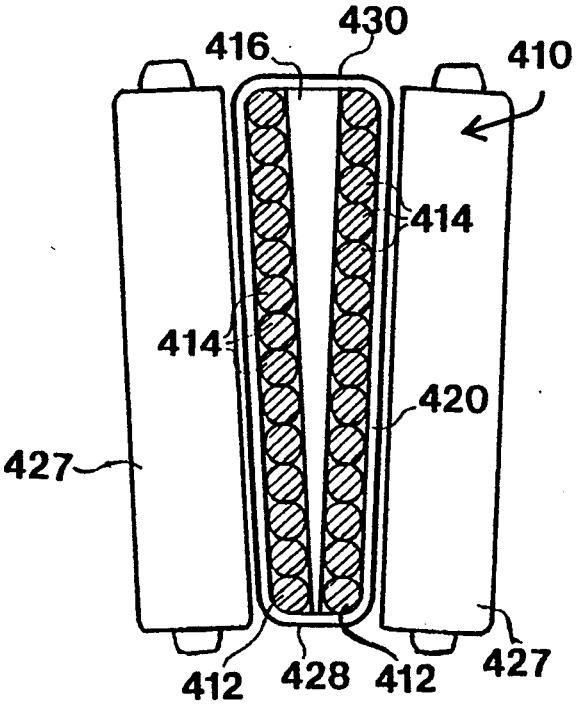
FIG. 4 is an elevational cross sectional view of a second equally preferred alternate embodiment of a correction coil cable assembly, according to the present invention.

A second equally preferred alternate embodiment of the present invention is illustrated in FIG. 4 and is designated therein by the general reference character 410. As can be seen in the drawing of FIG. 4, the second alternate embodiment 410 of the invention is very similar to the first presently preferred embodiment 10, having two wire arrays 412 with fourteen wires 414 each, a center rib 416 and an assembly housing 420. The essential difference between the first presently preferred embodiment 10 and the second alternate embodiment 410 of the invention is the elongated trapezoidal shape of the second alternate embodiment 410. The second alternate embodiment 410 is produced by rolling a portion of the correction coil cable 10 (FIG. 1), after assembly, between rollers (427) positioned so as to create a narrow end 428 and a wide end 430. Forming the second alternate embodiment 410 of the present invention into the shape illustrated in FIG. 4 is referred to as "keystoning" the purpose of which will be more clearly understood in relation to the subsequent discussion of the industrial applicability of the present invention.

It should be noted that, while the variation of overall shape of the correction coil cable 10 which results in the second alternate embodiment 410 of the invention is illustrated in FIG. 4 as resulting primarily from distortion in shape of the center rib 416 and the assembly housing 420, in actual practice it is recognized that some minimal distortion of the cross sectional shape of the wires 414 will also probably occur. Further, one skilled in the art will appreciate that the various figures of the drawing herein are diagrammatical in nature and that, specifically, the actual shape of the second alternate embodiment 410 of the invention which results from the above described process will be somewhat more irregular than is the well defined geometrical shape illustrated in FIG. 4. Finally, it should be noted that, while the second alternate embodiment 410 of the invention illustrated in FIG. 4 and described herein is a modification of the first presently preferred embodiment be of the invention, the first alternate embodiment 310 of the invention is equally amenable to modification according to the variation of the second alternate embodiment 410, as are any variations of the present invention not specifically described herein.

As is shown above, the correction coil cables 10, 310 and 410, according to the present invention, provide a means for holding conventional prior art wires 14, 314 and 414 in parallel arrays 12, 412 and 412. The substantial difference between the present invention and the prior art exists in the inclusion of a center rib 16, 316 and 416 and an outer housing 20, 320 and 420 which hold the wires 14, 314 and 414 in position relative to each other and which, in combination, constitute the useful and unique configuration of the inventive correction coil cable 10, 310 and 410. No materials other than those conventionally used in the construction of superconducting magnet coils are envisioned nor are any special constructions required.

Various modifications may be made to the invention without altering its value or scope. For example, any number of wires could be included in each wire array (within certain limits of practicality). Similarly, more or fewer than the two wire arrays shown herein could be included in a correction coil cable assembly. Furthermore, the dimensions and arrangements of components of the inventive correction coil cable, as described herein, are those which have been found to be optimal for the specific application to which the invention is currently being applied, that being the winding of SSC correction coils. Variations in the application would naturally result in corresponding variations in the specifications of the embodiment of the invention.

Another conceivable change would be to adapt the inventive correction coil cable assembly for use in the winding of coils other than those intended for the superconducting super collider and the like. For example, the superconducting wires used in the embodiments described herein could be replaced with wires intended for use in the range of normal conduction, to adapt the invention for use within that range. Similarly, the materials described herein could be replaced with less expensive substitutes if the intended use of the inventive coil cable were not to be in a cryogenic atmosphere, or in the presence of a radioactive field.

All of the above are only some of the examples of available embodiments of the present invention. Those skilled in the art will readily observe that numerous other modifications and alterations may be made without departing from the spirit and scope of the invention. Accordingly, the above disclosure is not intended as limiting and the appended claims are to be interpreted as encompassing the entire scope of the invention.

INDUSTRIAL APPLICABILITY

The correction coil cable is used in the winding of various types of electrical coils. The predominant current usages are for the winding of several different configurations of correction coils for the superconducting super collider.

The correction coil cable of the present invention may be utilized in a variety of application wherein conventional coil winding wires are used. The main area of improvement is in the regular orientation of the wires within the cable assembly and the corresponding avoidance of undesirable randomness, and in the ability of the correction coil cable to hold its shape during assembly of correction coils and during the use thereof.

The inventor has found that the two configurations illustrated by the presently preferred embodiment 10 of the invention and by the first equally preferred alternate embodiment 310 of the invention are sufficient to wind any of the various correction coils currently being used or proposed for use in the SSC project. The variation illustrated by the second equally preferred alternate embodiment 410 of the invention further improves the usefulness of the invention, as will be disclosed hereinafter.

Figure 5:
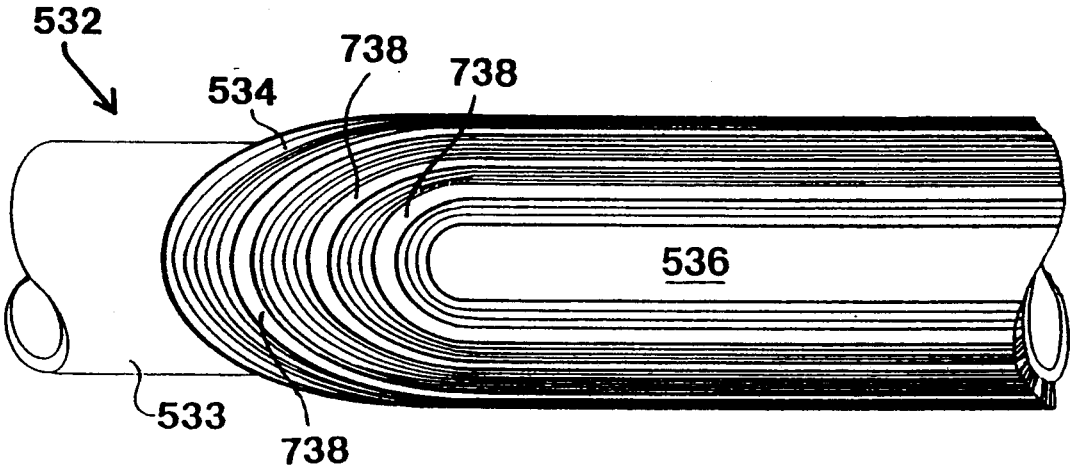
FIG. 5 is a plan view of a section of a particle tube of the SSC, showing a coil constructed using the inventive correction coil cable.
Figure 6:
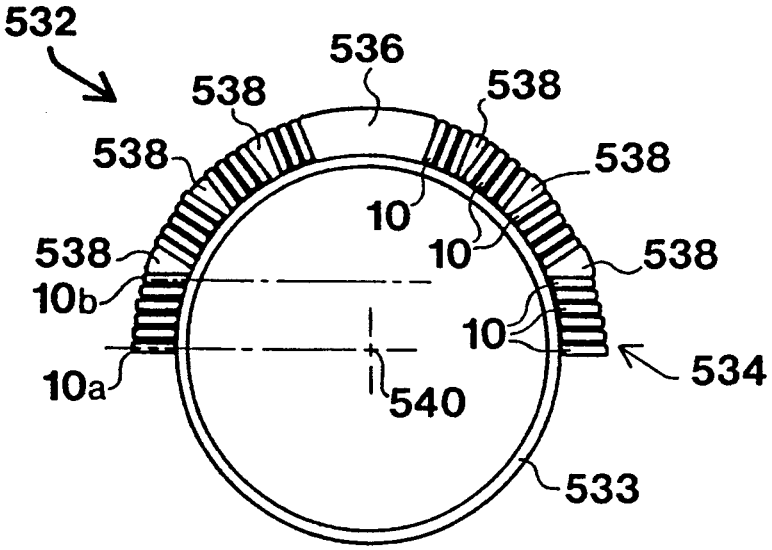
FIG. 6 is a cross sectional end view of the particle tube shown in plan view in FIG. 5.

FIG. 5 is a plan view of a segment of a particle tube assembly 532 of the SSC showing a particle tube 533 with a typical coil 534 wound around a winding land 536 thereon. The coil depicted in the view of FIG. 5 is made from the inventive correction coil cable 10. In the drawing of FIG. 5 portions of the coil 534 are separated by four spacing wedges 538. Now referring to FIG. 6, wherein is shown a cross sectional end view of the particle tube assembly 532, the positioning and function of the spacing wedges 538 can be more easily discerned. Wrappings of the correction coil cable 10 around the winding land 536 conform to the shape of the particle tube 533. One skilled in the art will appreciate that the spacing wedges 538 perform two functions. One of these functions is to properly position the correction coil cables 10 to conform to the local coil density requirements of a cosine theta winding pattern, which is an accepted pattern for winding the coil 534 such that local coil density is a cosine function of radial position around the particle tube. A second function performed by the spacing wedges 538 is to attempt to keep the correction coil cables 10 aligned radially with respect to the particle tube 533. As can be seen in the drawing of FIG. 6, this second purpose is only partially successful using only the correction wedges 538. For example, an end correction coil cable 10*a* is radially aligned toward a center 540 of the particle tube 533, while an interior correction coil cable 10*b* is less perfectly aligned.

Figure 7:
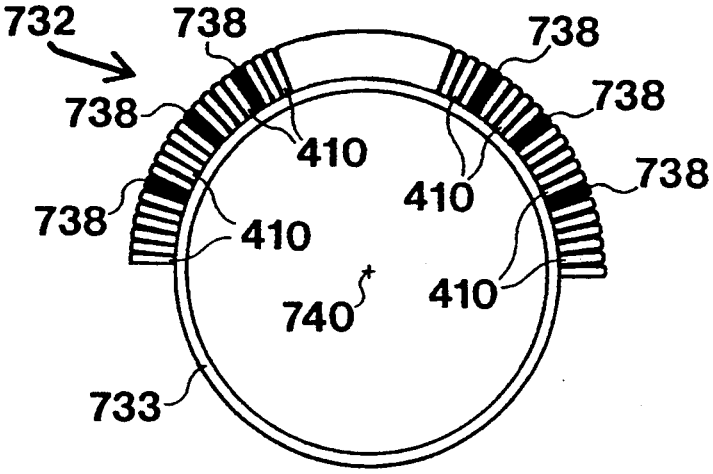
FIG. 7 is a cross sectional end view of a particle tube constructed using the second equally preferred alternate embodiment of the present invention.

Referring now to FIG. 7, wherein is shown a cross sectional end view of an alternate particle tube assembly 732 which differs from the particle tube assembly 532 of FIG. 6 in that the alternate particle tube assembly 732 is constructed using the second alternate embodiment 410 of the inventive correction coil cable which, as has been heretofore described, has been rolled into a keystoned shape. As can be seen in the drawing of FIG. 7, each of the correction coil cables 410 is radially aligned toward the center 740 of the particle tube 733. It should be noted that the spacing wedges 738 are adapted for use with the second alternative correction coil cable 410 and are, therefore, not identical in shape to the spacing wedges 538 illustrated in the example of FIG. 6.

The examples of applications of the inventive correction coil cables 10, 310 and 410 illustrated herein are by no means exhaustive of the possible applications of the invention. One skilled in the art will recognize that the examples of FIG. 5, FIG. 6 and FIG. 7 show one of a pair of dipole type coils. This configuration was chosen for illustration because it is easily illustrated. However, the inventor has found that the inventive correction coil cables 10, 310 and 410 are equally adaptable to other existing coil configurations including quadropole and sextupole types. Furthermore, it is anticipated that additional configurations not yet devised will benefit from application of the present invention.

Since the correction coil cables of the present invention may be readily constructed and may easily be utilized in application where conventional correction coil winding wires are used, it is expected that they will be acceptable in the industry as substitutes for the conventional winding wires. The inventive correction coil cables can be utilized with existing coil winding equipment. The inventive correction coils may be held in place during assembly using an epoxy, just as are conventional winding wires, and coils created thereby may be cured and treated in all respects just as are coils created using conventional winding wires. The inventor has found that, in addition to the fact that application of the present invention results in correction coils which are superior in performance as well as being more rugged and reliable in operation. For these and other reasons, it is expected that the utility and industrial applicability of the invention will be both significant in scope and long-lasting in duration.

I claim:

1. A wire cable assembly, including:

a flexible center rib positioned between a plurality of wire arrays, each of said wire arrays including a plurality of individual wires;

an assembly housing which surrounds the wire arrays and the flexible center rib such that said wire arrays and said flexible center rib are held in position relative to each other, wherein;

said individual wires are arranged to lie parallel to each other along a length of the cable assembly, and;

said assembled wire cable assembly is reformed such that it has a cross-section in the shape of a trapezoid, and;

said assembled wire cable assembly is formed by the action of rolling said wire cable assembly between two rollers, said roller being other than parallel such that said wire cable assembly is generally in the form of an irregular ribbon having a first narrow edge and a first wider edge, said first narrow edge and said first wider edge being the parallel sides of said trapezoidal shape and such that said flexible center rib has a second narrow edge and a second wider edge with said second narrow edge of said flexible center rib disposed adjacent and parallel to said first narrow edge and said second wider edge of said flexible center rib disposed adjacent to said first wider edge.

2. The wire cable assembly of claim 1, wherein:

said assembly housing includes an inner spiral wrap and an outer spiral wrap, said inner spiral wrap being a first tape which is wound around said center rib and said wire arrays in a spiral fashion, and said outer spiral wrap being a second tape which is wound around said center rib and said wire arrays in a spiral fashion.

3. The wire cable assembly of claim 1, wherein:

said individual wires are adapted for operation in superconduction, and said individual wires, said center rib and said assembly housing are constructed of materials capable of withstanding extreme cryogenic temperatures such as are encountered in low temperature superconductor applications.

* * * * *